US006449458B1

(12) United States Patent
Lang et al.

(10) Patent No.: US 6,449,458 B1
(45) Date of Patent: Sep. 10, 2002

(54) FIXING STATION FOR FIXING TONER IMAGES ON A SUPPORTING MATERIAL WITH A MOBILE COVERING DEVICE

(75) Inventors: Robert Lang, Eching; Werner Fuchs, Wörthsee; Gerd Goldmann; Andreas Eckardt, both of München; Günter Rosenstock, Ottobrunn, all of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/719,939

(22) PCT Filed: Jun. 17, 1999

(86) PCT No.: PCT/EP99/04191

§ 371 (c)(1),
(2), (4) Date: Mar. 2, 2001

(87) PCT Pub. No.: WO99/66372

PCT Pub. Date: Dec. 23, 1999

(30) Foreign Application Priority Data

Jun. 18, 1998 (DE) ..... 198 27 210

(51) Int. Cl.[7] ..... G03G 15/20
(52) U.S. Cl. ..... 399/336
(58) Field of Search ..... 399/67, 68, 69, 399/320, 335, 336, 337

(56) References Cited

U.S. PATENT DOCUMENTS 4,075,455 A 2/1978 Kitamura et al.
5,835,836 A * 11/1998 Hirao ..... 399/336
5,887,238 A * 3/1999 Matsuzoe et al. ..... 399/336

FOREIGN PATENT DOCUMENTS

| | | | |
|---|---|---|---|
| DE | 27 01 862 | | 7/1978 |
| EP | 0 629 930 A2 | | 12/1994 |
| JP | 53-054034 | * | 5/1978 |
| JP | 56-027183 | * | 3/1981 |
| JP | 06-003984 | * | 1/1994 |
| JP | 09-034307 | * | 2/1997 |

OTHER PUBLICATIONS

Japanese Abstract, Publication No. 62055685, Publication Date Mar. 11, 1987.

Japanese Abstract, Publication No. 60014268, Publication Date Jan. 24, 1985.

Japanese Abstract, Publication No. 53109632, Publication Date Mar. 7, 1977.

* cited by examiner

*Primary Examiner*—Sandra Brase
(74) *Attorney, Agent, or Firm*—Schiff Hardin & Waite

(57) ABSTRACT

A fixing station for a printer or copier includes a heating device for fusing toner to the carrier material and a cover that is selectively insertable between the heating element and the carrier material. The cover may be a window blind type cover. Where two sided fixing is provided, both heating devices have a cover. The cover may have an energy storage spring to cause the heating device to be covered in the event of an emergency. An electro-magnetic locking device may be provided to retain the cover in an open position.

38 Claims, 15 Drawing Sheets

| OPERATING CONDITION | RADIATION POWER LEVEL |
|---|---|
| CONTINUOUS PRINTING | 80% |
| BRIEF (< 10s) | 60% THROUGH 80% |
| LONG STOP (> 5 min) | 30% - 60% |
| STAND BY (> 5 min) | < 30% |
| AFTER START | 100% |

| | WINDOW BLIND POSITION | SAFETY RETURN | MOTOR COUPLING |
|---|---|---|---|
| OPERATION | OPEN | TENSED | ENGAGED |
| | CLOSED | RELAXED | ENGAGED |
| MALFUNCTION | OPEN | TENSED | DISENGAGED |
| | CLOSED | RELAXED | DISENGAGED |

| | WINDOW BLIND POSITION | SAFETY RETURN | LOCK | MOTOR COUPLING |
|---|---|---|---|---|
| OPERATION | OPEN | TENSED | LOCKED | ENGAGED |
| | CLOSED | RELAXED | LOCKED | ENGAGED |
| MALFUNCTION | OPEN | TENSED | UNLOCKED | DISENGAGED |
| | CLOSED | RELAXED | UNLOCKED | DISENGAGED |

FIXING STATION FOR FIXING TONER IMAGES ON A SUPPORTING MATERIAL WITH A MOBILE COVERING DEVICE

BACKGROUND OF THE INVENTION

1. Field of the Invention

The present invention is directed to a fixing station for fixing toner images on a carrier material, having a heating device with at least one radiant heat source that emits radiation in the direction of the carrier material, and having a cover device with which an undesired incidence of radiation onto the carrier material can be prevented.

2. Description of the Related Art

In electrographic printers or copiers, the toner image transferred from an intermediate carrier, generally a photoconductor, onto the carrier material, generally paper, must be fixed, i.e. it must be joined so as to be smear-proof and abrasion-proof to the carrier material. Heat/pressure fixing is currently usually utilized in electrophotography. When no pre-heating, for example with the assistance of a heating saddle, of the carrier material is undertaken, this is usually limited to approximately 0.5 m/s through 0.7 m/s in terms of processing speed. In the duplex printing mode wherein the front side and the back side of a carrier material are printed, the fixing process is relatively difficult because both sides are still covered with smearable toner images. A high fixing quality given simultaneous fixing of the front side and of the back side of the carrier material can only be achieved with relatively soft fixing drums, for example silicone drums. These fixing drums have a low service life and are uneconomical. Such soft fixing drums are therefore only utilized given printers having a relative low printing volume. Since soft fixing drums are utilized at both sides of the carrier material, the guidance of the carrier material becomes problematical. Such fixing drums are therefore not suited in the further-processing of continuous form paper.

For said reasons, it is desirable to fix toner images contact-free, whereby a relatively broad spectrum of carrier material can be utilized. Another goal of contact-free fixing is comprised in achieving a high fixing quality without smearing effects.

A contact-free fixing method is known wherein the toner material is softened with the assistance of a solvent material, so that it unites better with the fibers of the carrier material. When, however, chromatic toner is employed, it can occur that the color pigments are dissolved to different extents, which can potentially lead to a color-dependent smearing of the toner images. Moreover, the known environmental problems given the utilization of solvents arise.

Another known fixing method that works contact-free is what is referred to as photoflash fixing, whereby the toner is fixed on the carrier material with the assistance of high-energy light pulses. The wavelength of the radiation usually lies in the visible through ultraviolet range of the spectrum. Since the various color toners absorb to different extents in this wavelength range, a photoflash fixing is not suitable for multi-color printing.

Another fixing station is disclosed by European Patent Document EP-A-0 629 930. The fixing station is employed for an electrostatic printer in order to fix toner material on paper. The cover device serves the purpose of preventing the incidence of radiation during a heating-up phase or during a standstill of the carrier material. In the closed condition of the cover device, the active surfaces of the radiant heat source emitting thermal radiation face away from the carrier material. In this condition, the cover device surrounds the radiant heat source, so that the heating-up phase is shortened. During normal operation wherein the toner material is fixed on the carrier material as a consequence of the incident radiant heat, the radiant heat source faces toward the carrier material and the radiation can impinge the carrier material unimpeded.

Japanese Patent Document JP-A-62-055685 discloses a fixing device wherein a cover device can be moved into the beam path between a radiant heat source and a carrier material. The cover device comprises a plate of heat-resistant material. The cover device is removed from the beam path in the normal operating condition. Given an abnormal operating condition, the cover plate is shoved between the carrier material and radiant heat source.

The Japanese Patent document JP-A-60-014268 is directed to a fixing device wherein a cover plate can be moved into the beam path between a radiant heat source and a carrier material. The intensity of the fixing is set with the assistance of this cover plate dependent on the paper thickness of the carrier material. A detector thereby determines the paper thickness, whereupon the cover plate is swivelled. The fixing device can be set to different paper thicknesses relatively fast in this way.

SUMMARY OF THE INVENTION

An object of the invention is to provide a fixing station that works with high processing speed and assures a high print quality.

This object is achieved by a fixing station for fixing toner images on a carrier material, including a heating device with at least one radiant heat source that emits radiation in the direction of the carrier material, and having a cover device movable essentially parallel to the moving direction of the carrier material and that can be moved in to the beam path between radiant heat source and carrier material, in that, given a stop of the carrier material, the cover device is moved with the velocity $V_R$, according to the relationship: $V_R=-V_P$, wherein vp is the transport velocity of the carrier material; and in that, given continued transport of the carrier material with the velocity $V_P$, the cover device is moved with the velocity $V_R$, according to the relationship: $V_R=V_P$. Advantageous developments provided by the cover device having at least the width of the carrier material. Specifically, the cover device is flexible as viewed in moving direction of the carrier material. In one embodiment, the cover device contains a band. Alternately, the cover device contains a plurality of strip-shaped lamellae that form a window blind, whereby adjoining lamellae preferably overlap. The band or, respectively, the lamellae can be wound up in the fashion of a winding.

In a preferred embodiment, an endless deflection means is arranged around the heating device; and the band or, respectively, the window blind can be moved along the deflection device. The deflection device may contain a tensing mechanism that keeps the band or, respectively, the window blind in a tensed condition. A feature of the invention provides that the cover device has a length that is adequate in order to cover the entire radiation of the radiant heat source in the direction of the carrier material. The cover device may contain a rigid plate for covering the radiation.

The fixing station of one embodiment has a radiant heat source with a radiation temperature in the range from 500° C. through 800° C. and the maximum intensity of the radiation lies at a wavelength greater than 2 $\mu$m. In one embodiment, a respective heating device each having at least one radiant heat source is arranged at both sides of the carrier material, whereby a respective cover device can be moved into the beam path between radiant heat source and carrier material, whereby both cover devices are preferably moved by a common drive. Such a fixing station may be employed for a printer device or copier device that works in duplex printing mode.

A ceramic flat radiator, a crystal radiator or, in particular, a foil radiator can be employed as the radiant heat source. In one aspect of the invention, the radiant heat source is pre-heated. Specifically, the radiant heat source is pre-heated to a temperature above 200° C.

Advantages of the invention are realized when a temperature Tm is established in the steady state at the carrier material given an operation of the radiant heat source with nominal power NL; and the radiant heat source is preheated such that a temperature of approximately 0.45 Tm is established on the carrier material. A further feature of the invention is that a temperature sensor acquires the temperature on the carrier material, preferably when it departs the fixing station; and the energy supplied to the radiant heat source is set such that it lies slightly above the fixing temperature Tf. The fixing temperature amounts to, for example, 0.8×Tm.

A feature of the invention provides that a power control is provided that supplies electrical energy to the radiant heat source; in the operating condition with constant printing, the power control sets a power of approximately 80% NL, whereby NL is the nominal power; in the operating condition with short stoppage of less than 10 seconds, the power is to set to 60% through 80% NL; given an operating condition with long stoppage of >10 seconds through <5 minutes, a power of 30% through 60% NL is set; in the operating condition of standby mode having a waiting time of >5 minutes, a power of less than 30% NL is set; and given the start operating condition, a power of 100% NL is set.

Each radiant heat source is divided to a plurality of zones that are respectively separately supplied with the electrical energy; and the zones are supplied with electrical energy dependent on the width of the carrier material. As a preferred development, zones opposite which no carrier material resides are driven with reduced power. In one example, a longitudinal edge of the carrier material lies within a zone. Further, a plurality of zones are combined and driven like a single zone. In embodiments having two heating devices, zones residing opposite one another are driven with the same power. The zones residing opposite one another may be connected in series. As a further aspect, the power control ensues with a pulse packet control or a phase control.

A temperature regulation ensues such that a temperature higher than the fixing temperature is set in zones having carrier material and a lower temperature is set in zones without carrier material. A temperature regulation ensues only in zones with carrier material.

The cover device may be connected to a safety mechanism that contains an energy store; and, given outage of the drive for the cover device, energy is taken from the energy store with which the cover device is moved by the safety mechanism into the beam path between radiation source and carrier material. In an exemplary embodiment, the energy store is a spring energy store that preferably contains a linear spring, a rotatory spring or a gas spring. The energy store is filled with energy given every closing movement of the cover device, or alternately, the energy store is filled once with energy by a drive of the cover device and is subsequently locked by a locking mechanism; and the locking is released given outage of the drive. The locking mechanism may contain an electromagnet that is permeated by current during normal operation; and the lock is released given outage of the current and drop-off of the electromagnet. The drive for the cover device may contain a magnetic coupling that uncouples the drive given outage of the drive.

Shock absorbers that damp the impact of the cover devices are contained in the heating devices.

The traction means is conducted over a deflection roller.

The locking mechanism contains a swivel lever with an oblong hole guide; the retainer magnet holds the swivel lever at its projecting end; a cross pin of the deflection roller is guided in a stationary longitudinal guide and in the oblong hole guide; given a drop-off of the retaining magnet, the swivel lever is turned until oblong hole guide and longitudinal guide are aligned with one another and the cross pin moves in both guides.

According to the invention, the heating device contains a radiant heat source as a result whereof the fixing procedure ensues contact-free. Problems related to the guidance and the pressure charging of fixing drums are thus avoided. The employment of a radiant heat source, however, has the disadvantage that the heating of the cooling of the carrier material involves a relatively high time constant, as a result whereof problems arise when starting printing, given standstill of the carrier material or given intermittent printing. According to the invention, a cover device is proposed that can be moved into the beam path between radiation source and carrier material or given intermittent printing. According to the invention, a cover device is proposed that can be moved into the beam path between radiation source and carrier material. With the assistance of this cover device, defined exposure time for achieving an optimum fixing can be achieved even given frequent starting and stopping of the movement of the carrier material. Due to the contact-free heating of the carrier, a high color reproducibility and uniformity of the fixing of the toner image can be achieved.

The fixing station is preferably employed for a printer device or copier device having high printing performance that works in duplex printing mode, whereby toner images of the front side and of the back side of the carrier material are simultaneously fixed. In this operating mode, heating devices and corresponding cover devices are provided at both sides of the carrier material.

BRIEF DESCRIPTION OF THE DRAWINGS

Exemplary embodiments of the invention are explained below with reference to the drawing.

DETAILED DESCRIPTION OF THE PREFERRED EMBODIMENTS

Figure 1:
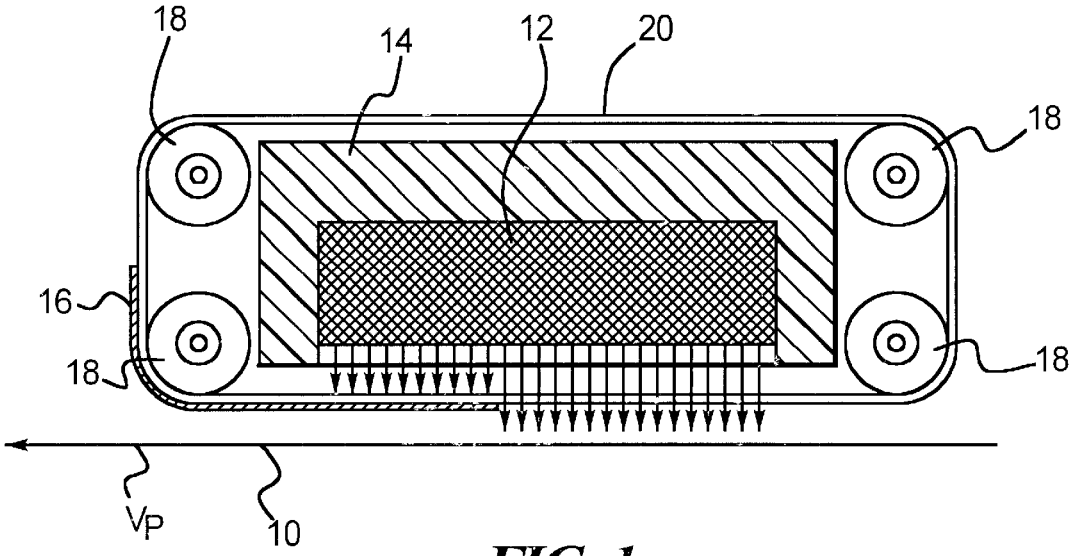
FIG. 1 is a schematic longitudinal section through a fixing station having a cover device in the fashion of a window blind.

FIG. 1 shows a longitudinal section through a fixing station of the invention. This fixing station is utilized in a high-performance printer that prints a paper web 10 double-sided. In the illustration of FIG. 1, only the upper part of the fixing station is shown, this charging the upper side of the carrier material with thermal energy for fixing toner images. An identical apparatus (not shown) is provided at the underside of the paper web 10, toner images on the underside being fixed therewith. The fixing station contains a radiant heat source 12 that is fashioned as a foil radiator. Such a foil radiator has 50 $\mu$m thick bands that assume a temperature <800 ° C. when charged with current. The advantage of a foil radiator is comprised therein that it has a low thermal capacity and can thus be quickly heated and just as quickly cooled. Other radiant heat sources that can be employed are ceramic flat radiators wherein the heating coil is embedded in ceramic compound. Likewise, crystal radiation sources can be employed wherein the globe coil is installed in crystal tubes.

An insulation 14 that has a downward opening for the emergence of the radiant heat is provided around the radiant heat source 12. A cover device 16 that can be moved into the beam path between the radiation source 12 and the paper web lO is arranged between the radiant heat source 12 and the paper web 10. In the present case, the cover device 16 contains strip-shaped lamellae that are combined in the fashion of a window blind 16. The cover device 16 is thus flexible as viewed in the moving direction of the paper web 10 and can be deflected at deflection rollers 18. One of the deflection rollers 18, for example that shown at the lower right in FIG. 1, is driven by a drive. The strip-shaped lamellae that form the window blind 16 are tensed between two circulating toothed belts 20 (only one toothed belt 20 can be seen in FIG. 1). Due to forward or backward movement of the toothed belt 20, the window blind 16 can be moved into the beam path between the radiation source 12 and the paper web 10 in order to thus shield thermal radiation from impinging the paper web 10. The length of the window blind 16 is dimensioned such that, in its closed condition, it covers the entire radiation-emitting region of the radiant heat source 12. Alternatively, to the toothed belt 20, two wire cables or chains can also be employed.

The transport mechanism with the toothed belt or wire cable drive is located at both sides outside the emission region of the radiant heat source 12. The deflection means formed by the deflection rollers 18 is thus compact and occupies little space.

The cover device 16 is exposed to relatively great temperature differences. In the opened condition, room temperature is approximately present; in the closed condition, the cover device 16 can assume a temperature of up to approximately 600 ° C. As a result of the length changes due to the temperature differences, a clamp mechanism is provided at at least one deflection roller 18 (this clamp mechanism not being shown). This clamp mechanism generates a constant tension in the toothed belt 20, so that the window blind 16 is also tensed. The clamp mechanism can be realized, for example, with a belt tensioning means having a durably applied spring tension. In order to intercept a change in length transversely relative to the paper web 10 due to temperature differences, the deflection rollers 18 are arranged axially adjustable.

Figure 2:
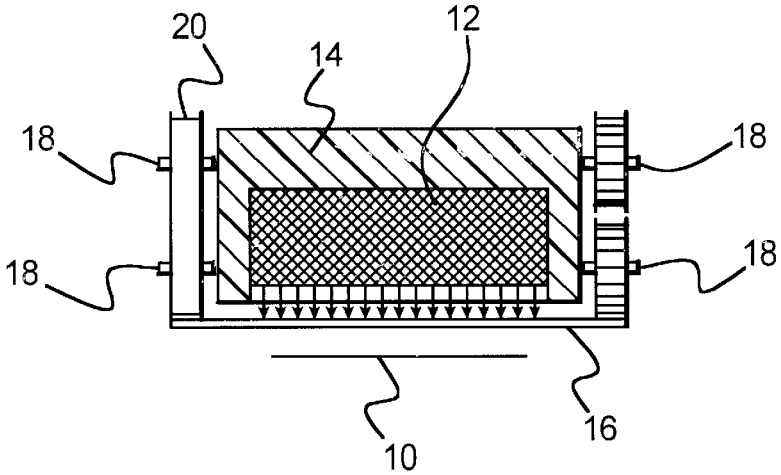
FIG. 2 is a cross-section through the fixing.station of FIG. 1.

FIG. 2 shows a cross-section through the arrangement of FIG. 1, whereby the window blind 16 is in its closed position. The deflection rollers 18 are occupied with the circulating toothed belt 20 at the left in FIG. 2. The toothed belt 20 has been omitted at the right side.

Figure 3:
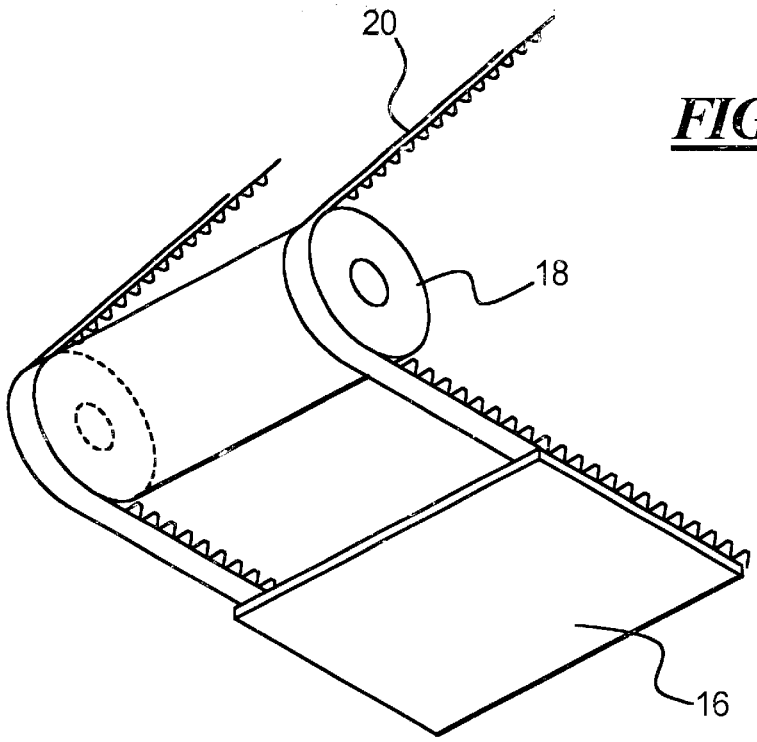
FIG. 3 is a band-shape cover device.

FIG. 3 shows an exemplary embodiment of the cover device 16' realized as a flexible band.

Figure 4:
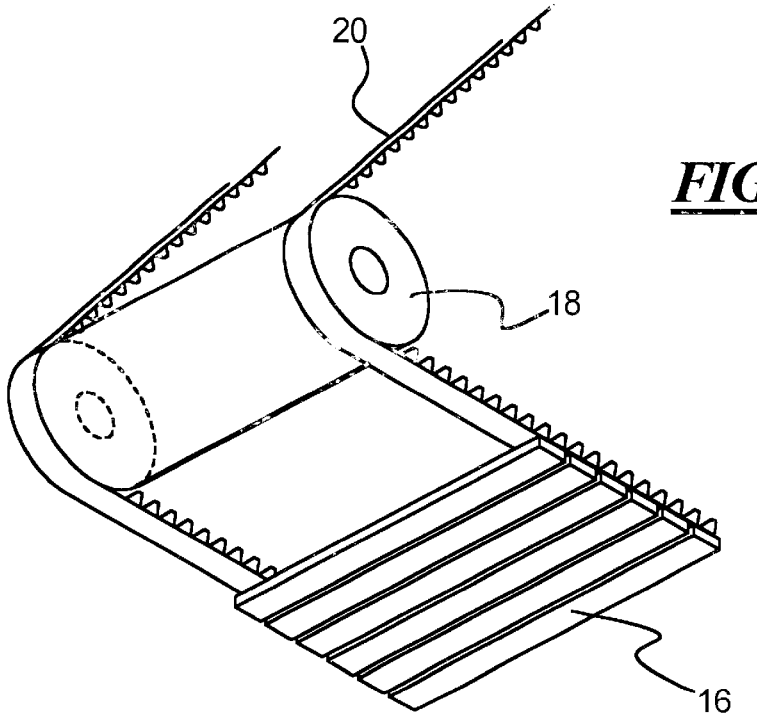
FIG. 4 is a cover device in the fashion of a window blind having strip-shaped lamellae.

FIG. 4 shows the stripe-shaped lamellae that, overall, form the window blind 16. The individual lamellae are composed of highly temperature-resistant material, for example sheet steel, having a typical thickness of 0.1 through 0.3 mm. Materials in the form of bands or plates or fabric having low thermal conduction such as, for example, glass fibers, silicate fibers or ceramic fiber paper can also be employed, these assuring an optimally low thermal load on the paper web 10 in the closed condition. For stabilization, the lamellae can be applied on a temperature-resistant, tear-resistant supporting grid. The aforementioned fiber products can also be employed together with metal; the fiber products then serve for additional heat damming.

An embodiment is also conceivable wherein the flexible band or, respectively, the lamellae can be wound up in the fashion of a winding, i.e. the closed deflection device shown in FIG. 1 is replaced by a take-up reel and an unwinding reel on which the window blind or, respectively, the band is rolled up and from which it is unrolled.

The lamellae can be formed of relatively inflexible material, for example of ceramic or of hollow profiles of steel. Such hollow profiles, which can in turn be composed of U-profiles, are preferably flooded with air for cooling.

The movement of the cover device is dependent on the operating condition of the paper web 10. When the paper web 10 stops, the cover device 16 is closed with the velocity $V_R$ according to the relationship $V_R=-V_P$, wherein $V_P$ denotes the transport velocity of the paper web 10. This means that the fixing event, even given a sudden standstill of the paper web 10 due, for example, to a paper jam or due to an operationally caused stopping of the paper web 10, is still maintained for the section of the paper web located under the radiant heat source 12 for a length of time during which it would have been charged with radiant heat given normal further-transport. The section located under the radiant heat source 12 is thus still adequately exposed in order to fix the toner images, despite the stopping of the paper web 10.

Given further transport of the paper web 10 with the velocity $V_P$, the cover device is opened in the same direction with the velocity $V_R$. The relationship $V_R=V_P$ thus applies. What is thus achieved is that the new section of the paper web 10 coming under the radiant heat source 12 is charged with the correct dose of radiant heat. The preceding section of the paper web 10 is not overexposed.

The cover devices 16 shown in FIGS. 1 through 4 are flexible. In an alternative embodiment, however, it is also possible to employ a rigid plate that can be moved as needed into the beam path between the radiant heat source 12 and carrier material 10 with a drive mechanism.

The radiant heat source 12 has a preferred radiation temperature in the range from 500° C. through 800° C. Its maximum radiant intensity lies at a wavelength >2 $\mu$m.

When printing in an electrographic printer, what are referred to as start/stop events occur from the greatest variety of reasons, the paper transport having to be halted fork certain time therein; for example, given an interruption of the electronic data stream, given the necessity for cleaning events in the printing unit or given specific paper transport movements. Since the radiant heat sources that are employed have a relatively high time constant when heating up, one must wait for a relatively long time given a continued transport of the paper web 10 until the fixing station is again ready to be used in order to fix toner images with high quality. On the other hand, it can be meaningful when halting the paper transport to reduce the energy supply in order to avoid an unnecessary heating of the fixing station and of the paper web. Accordingly, it is desirable to achieve an optimally fast heating given minimum power consumption.

Figure 5:
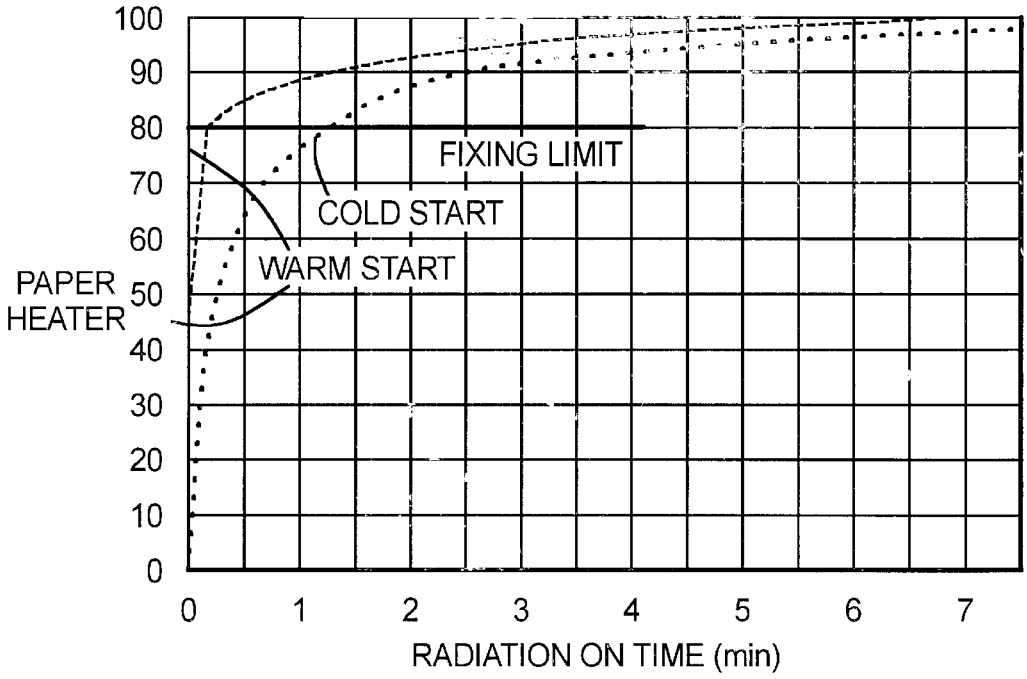
FIG. 5 is a graph showing the power supply to the heating device via the on-time in the operating modes of cold start and warm start.

FIG. 5 shows a diagram of the typical heating behavior of a paper web in the steady state, i.e. a radiant heat source is permanently operated with nominal power NL, as a result whereof a maximum paper temperature Tm that is recited as 100% occurs. This maximum paper temperature Tm is only achieved after a time of eight minutes. Typically, the paper temperature then amounts to 180° C. A fixing of the toner is only achieved above a fixing limit at a fixing temperature Tf. It typically amounts to 80% of the maximum temperature Tm. The time until the fixing limit is reached typically amounts to 1 through 3 minutes when heating is carried out proceeding from room temperature. Such an operating condition is referred to as cold start. Except when switching the printer on, such a time is unacceptable for a fast printing mode.

When the radiant heat source is permanently held at a temperature that lies clearly above room temperature, for example above 200° C., then the heating-up time until the fixing limit is reached can be considerably shortened. FIG. 5 shows a curve referred to as warm start wherein the energy supplied to the radiant heat source is set such that the paper heats to approximately 45% of the obtainable final temperature. When the fixing station is then to begin its normal operation, the radiant heat source is operated with nominal power NL, whereby the fixing limit with fixing temperature Tf is reached within ten seconds. At the same time, the power with which the radiant heat source is driven is clearly reduced in faces wherein printing mode does not ensue. For example, this power then amount to only 40% of the nominal power NL.

The radiant heat source is operated with nominal power NL until the fixing limit is reached. After the fixing limit is reached, the power is set such that the temperature of the paper at the end of the fixing station, i.e. in regions of the paper that leave the fixing station, lies slightly above the fixing temperature Tf. Due to this type of regulation of the paper output temperature, one is largely independent of the material employed; in particular, this procedure is independent of the paper weight.

Figure 6:
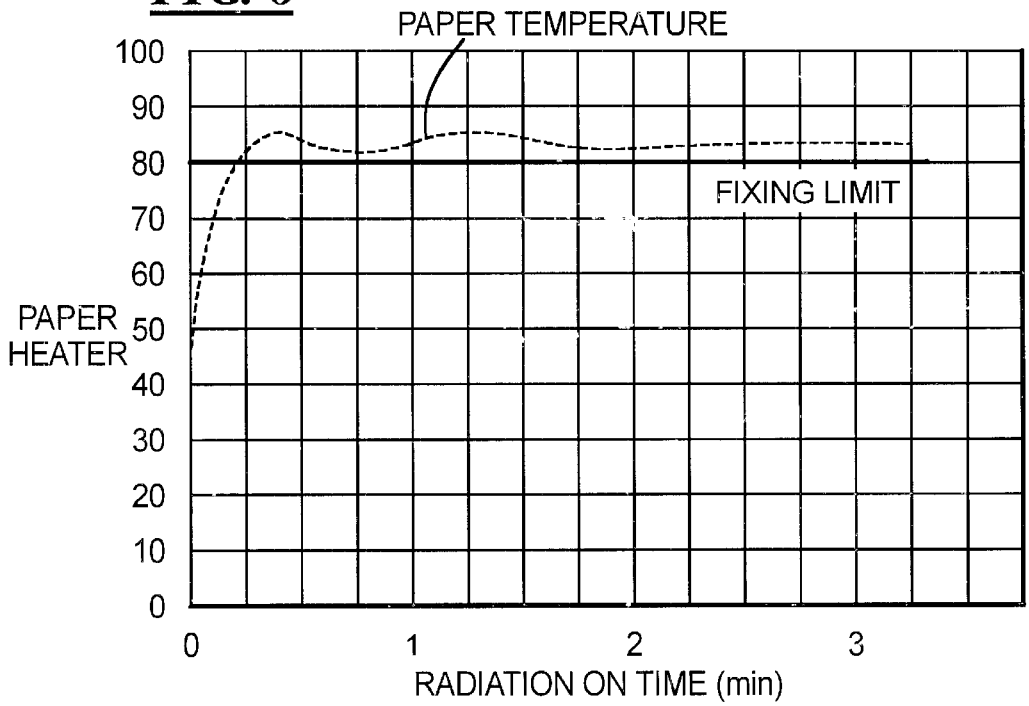
FIG. 6 is a diagram for illustrating the control of the heating power.

In a diagram similar to that of FIG. 5, FIG. 6 shows the paper temperature over time. Due to the pre-heating, the fixing limit is quickly exceeded. Subsequently, the regulation sees to it that the paper temperature lies slightly above the fixing limit when leaving the fixing station.

Figures 7, 8:
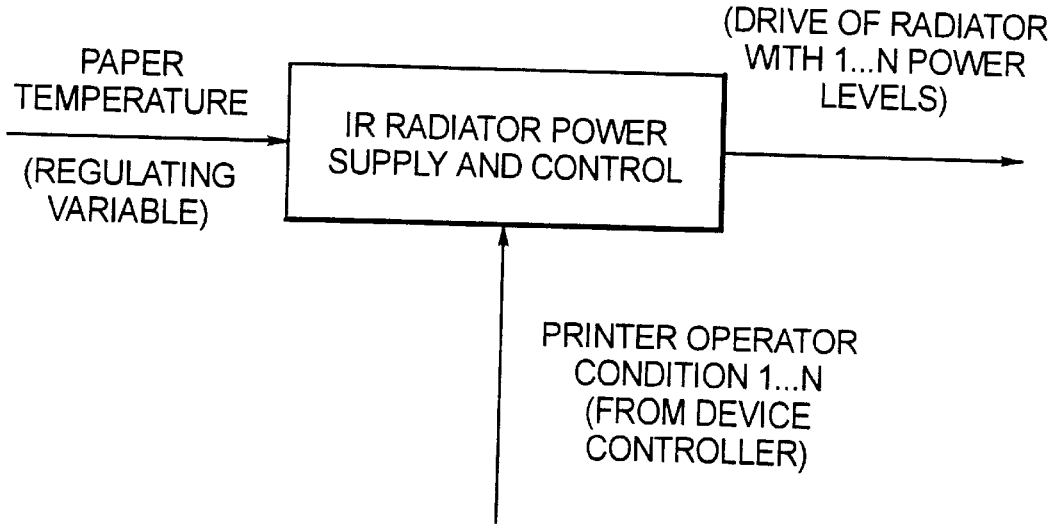
FIG. 7 is the tabular allocation of the supplied power dependent on the operating condition.
FIG. 8 is a block circuit diagram of the power control for the radiant heat source.

FIG. 7 shows the selected power for the radiant heat source dependent on the operating condition. In the operating condition of "continuous printing", the power supplied to the radiant heat source amounts to approximately 80% of the nominal power NL. In the operating condition with brief stoppage of the paper web, the power amounts to approximately 60 through 80% of the nominal power NL. In the operating condition with longer stoppage of the paper web, for example <5 minutes, the power amounts to 30 through 60% of the nominal power NL. In standby mode, given a stoppage of the paper web for longer than 5 minutes, the power amounts to less than 30% of the nominal power NL. Given continued transport of the paper web following a pause, the supplied power amounts to 100% of the nominal power NL.

FIG. 8 shows the schematic block illustration of the control of the radiant heat source that has different power stages 1 . . . N. These power stages are dependent on said operating conditions 1 . . . N of the printer. The temperature of the paper web at the output of the fixing station serves as regulating variable.

Figure 9:
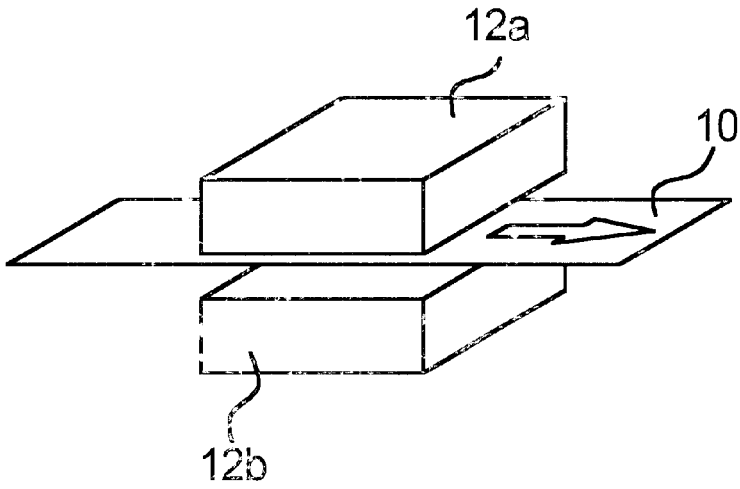
FIG. 9 is a perspective view which shows schematically, the arrangement of two heating devices at both sides of the carrier material.

FIG. 9 schematically shows an arrangement for a fixing station as employed in duplex printing mode. The paper web 10 is irradiated by an upper radiant heat source 12*a* and by a lower radiant heat source 12*b* in order to fix toner images on both sides of the paper web 10. Each radiant heat source contains a plurality of zones Z1 through Z6 (see FIG. 10) that can be respectively driven independently of one another. For example, the various zones Z1 through Z6 are realized by heating foils whose connections are separately conducted out.

A fixing station must be able to process paper webs having different widths. It is required for a high fixing quality that the intensity of the irradiation is relatively uniform over the entire width of the paper web, so that a uniform temperature is established. Given a radiant heat source, a drop in the radiant intensity occurs toward the edge. On the other hand, an overheating can occur given the arrangement according to FIGS. 1 and 2 and given hot zones residing opposite one another without a paper web, since no thermal energy is conveyed out by the paper web. In such a case, overheatings can occur at the edge of the paper web, quality deficiencies occurring as a result thereof.

Figure 10:
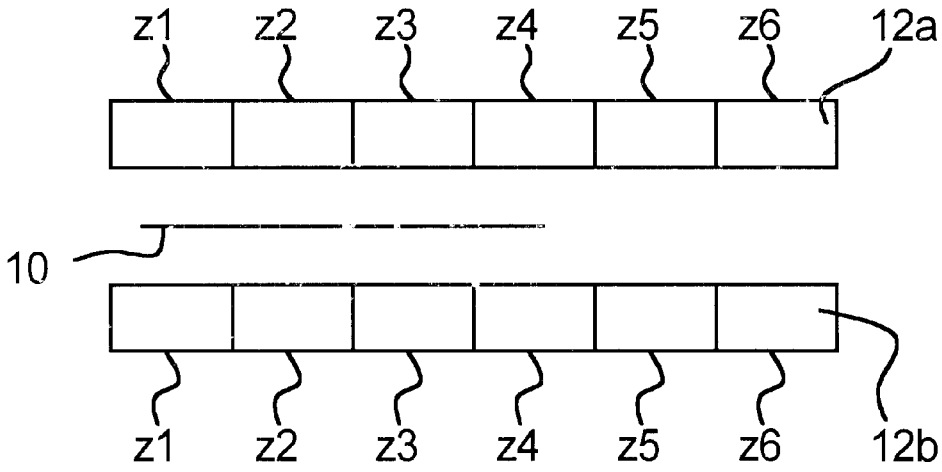
FIG. 10 is a schematic representation of the division of the heating device into various zones.

At its left side, the paper web 10 shown in FIG. 10 has a stationary paper edge; the other paper edge, dependent on the format width, enters into the radiant heat sources 12*a* and 12*b* lying opposite one another. In order to compensate for the drop of the radiant intensity in the zones Z1 toward the edge, the edge at the left side is displaced toward the right. In order to minimize the control outlay for controlling the various, independent zones Z1 through Z6, zones Z1 through Z4 wherein the paper web 10 resides opposite these zones are combined. Each zone residing opposite is then driven with the same heating power. When the format width increases, then individual zones, for example the zone Z5 or the zones Z5 and Z6 are connected together.

Figure 11:
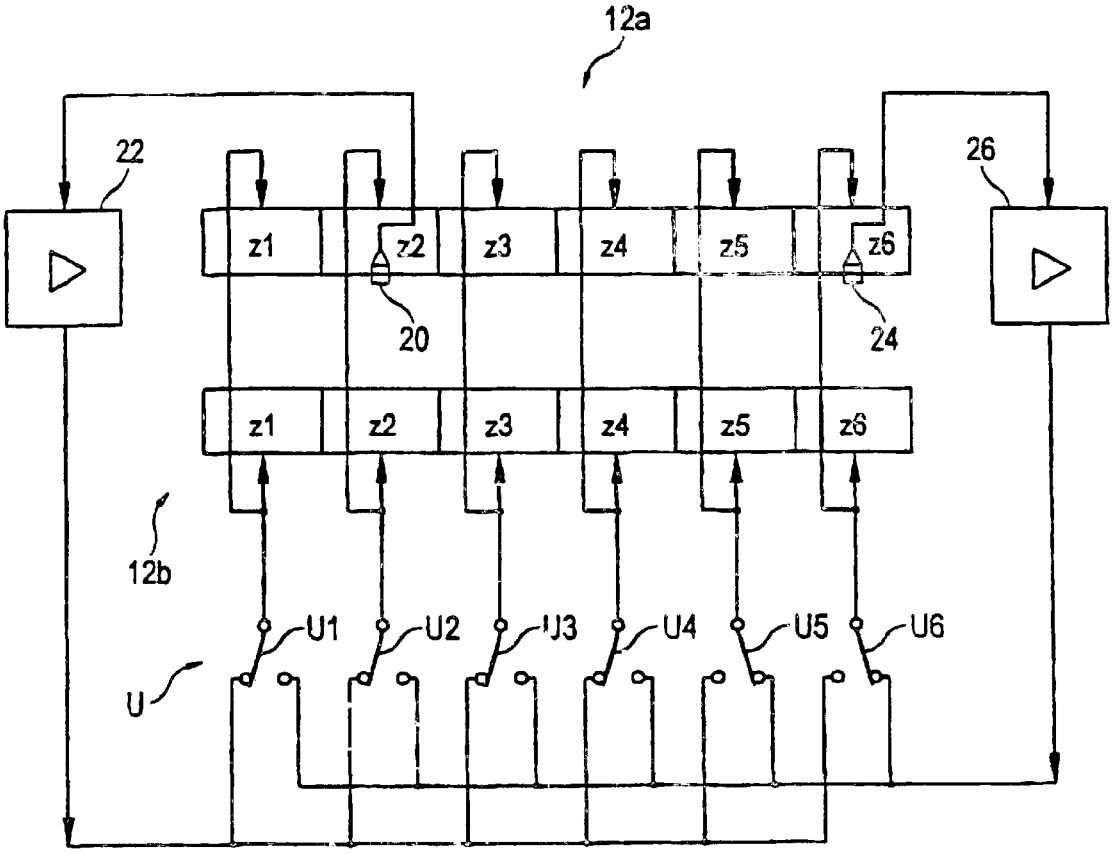
FIG. 11 is a circuit diagram which shows schematically, the drive of different zones.

FIG. 11 shows a circuit arrangement for the drive of the various zones Z1 through Z6 of the radiant heat sources 12*a* and 12*b*. In the present case, zones Z1 through Z6 residing opposite one another are connected in parallel. However, it is also possible to connect zones residing opposite one another in series, as a result whereof the voltage dropping off per zone is cut in half. For example, the energy supply can ensue with a pulse packet control or a phase control. Given the pulse packet control, the zones Z1 through Z6 are supplied with a plurality of current pulses per time unit that is dependent on the power to be set. A regulation of the temperature is outlined in FIG. 11. A temperature sensor 20 acquires the surface temperature of the paper web 10 that extends along the zones Z1 through Z4. The signal of the sensor 20 proceeds to a control unit 22 that supplies the combined zones Z1, Z2, Z3 and Z4 with power such that a constant temperature is set. A second sensor 24 acquires the temperature in the region wherein no paper web 10 resides opposite the zones Z5 and Z6. The signal of the sensor 24 is supplied to a regulator 26 that supplies the combined zones Z5 and Z6 with electrical energy such that a lower temperature is set in these zones Z5 and Z6 than in the zones Z1 through Z4 that emit radiant energy onto the paper web 10. In this way, an overheating is avoided in the edge region of the paper web 10 and a uniform temperature profile over the width of the paper web 10 is nonetheless achieved.

A switchover means U having a plurality of switches U1 through U6 determines how the various zones Z1 through Z6 are combined. Dependent on the width of the paper web 10, switching is carried out between the illustrated positions such that the respective zone Z1 through Z6 is driven either by the regulator 22 or by the regulator 26. The setting of the switches U1 through U6 can, for example, be realized with the assistance of a suitable operating condition hardware. In this way, the entire fixing station with two radiant heat sources 12*a*, 12*b* divided into zones can be regulated by two control circuits. A further simplification derives when a direct control of the supplied heat power ensues in the region without paper web 10. The sensor 24 can then be omitted.

As mentioned, the radiant heat sources employed are relatively inert, so that an overheating of the carrier material can nonetheless occur given a stoppage of the carrier material and a shut-off of the energy supply to the radiant heat source. This overheating can be so pronounced that the carrier material, for example paper, ignites. It must therefore be assured that the cover device functions reliably even given outage of the drive motor, for example when the power fails, in order to preclude a dangerous situation. One exemplary embodiment of the invention is characterized in that the cover device is connected to a safety means that contains an energy store, and that, given outage of the drive for the cover device, energy is taken from the energy store with which the cover device is moved into the beam path between the radiation source and the carrier material by the safety device. An electrical, pneumatic, magnetic or a mechanical store can be employed as the energy store. Preferably, mechanical spring energy is stored in the energy store i.e. it contains a linear spring, a rotatory spring or a gas compression spring.

Figure 12:
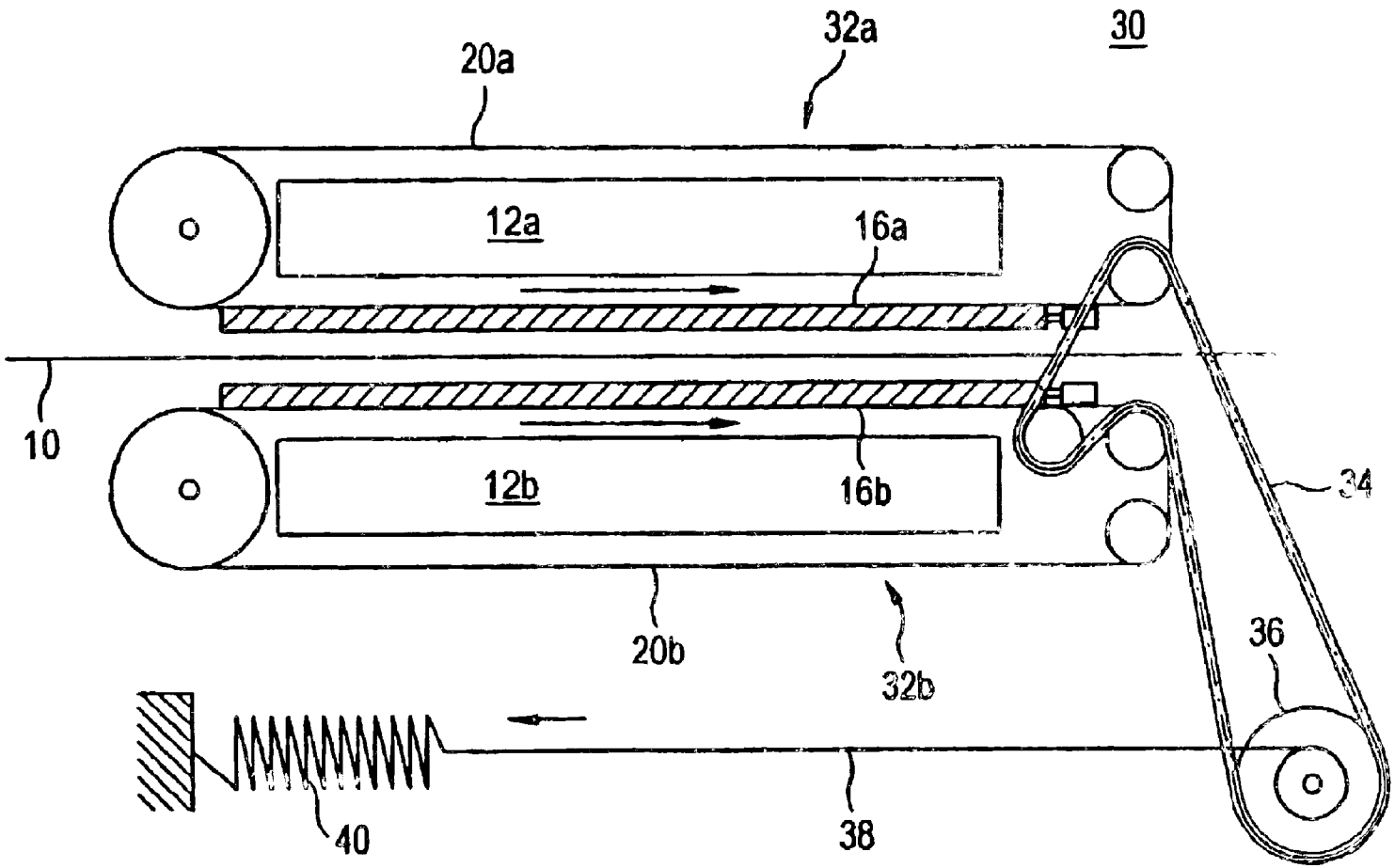
FIG. 12 is a side sectional view of an exemplary embodiment of a safety means having a spring store.
Figures 13, 14:
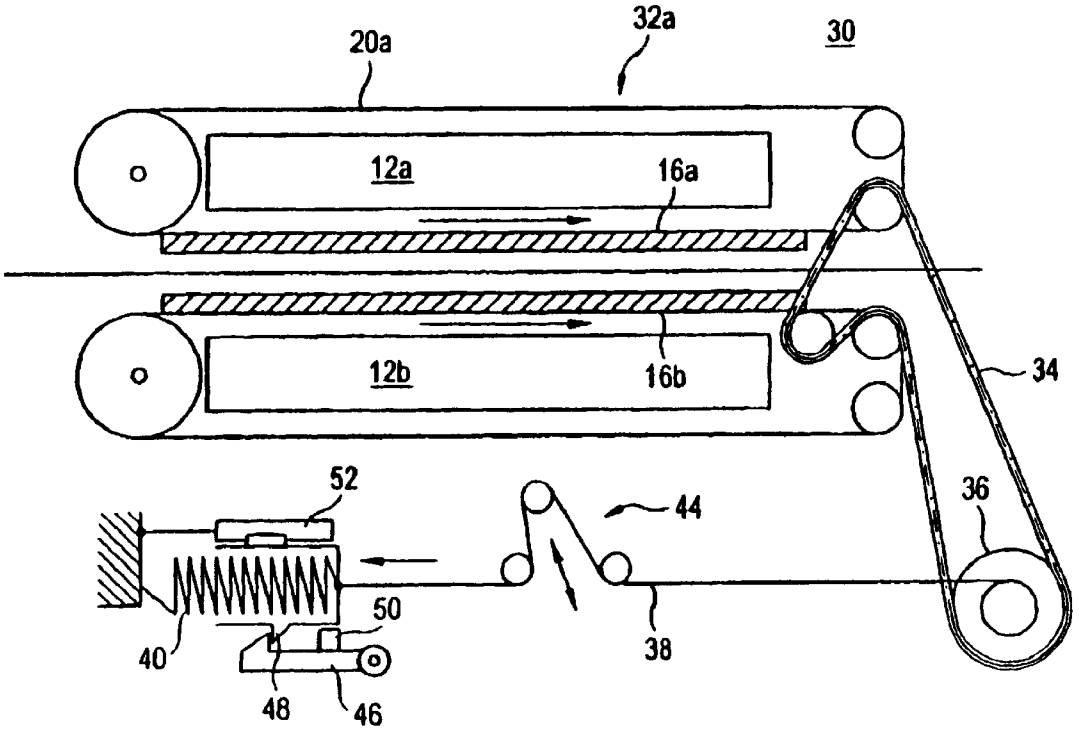
FIG. 13 is a status table for normal operation and given the occurrence of a malfunction.
FIG. 14 is a side cross section of a safety device having an interlock element.

A simple exemplary embodiment of a safety device is shown in FIG. 12. The entire fixing station 30 contains two heating devices 32*a* and 32*b* that heat the paper web 10 at both sides. The respective cover devices 16*a* and 16*b* are moved by toothed belts 20*a* and 20*b*. The two toothed belts 20*a* and 20*b* are driven by a belt or a chain 34 via drive wheels and shafts, the belt or chain 34 being placed around a drive shaft 36. A motor engages at the drive shaft 36. A magnetic coupling is connected between the drive shaft 36 and motor, this uncoupling the motor shaft given outage of the motor. A wire cable 38 as a traction means is also connected to the drive shaft 36, this in turn being connected to a linear spring 40. At every back and forth motion of the motor shaft in both rotational senses in order to close or open the cover devices 16*a* and 16*b*, the spring 40 is tensed and relaxed when the wire cable 38 is wound onto the drive shaft 36. When a power outage occurs and the cover devices 16*a* and 16*b* are in their open condition, the motor is released from the drive shaft 36 via the magnetic coupling and the wire cable 38 turns the drive shaft 36 upon relaxation of the spring 40 such that the cover devices 16*a* and 16*b* completely cover the radiations emitted by the radiant heat sources 12*a* and 12*b*. In order to avoid a hard impact of the cover devices 16*a* and 16*b* on their limit position in such a condition, shock absorbers 42*a* and 42*b* are provided that absorb the impact. The elements of spring 40 and wire cable 38 form a safety pull-back. Instead of the wire cable 38, a chain or a toothed belt can also be employed. FIG. 13 shows a status table for the normal mode and for a malfunction.

Figures 15, 16:
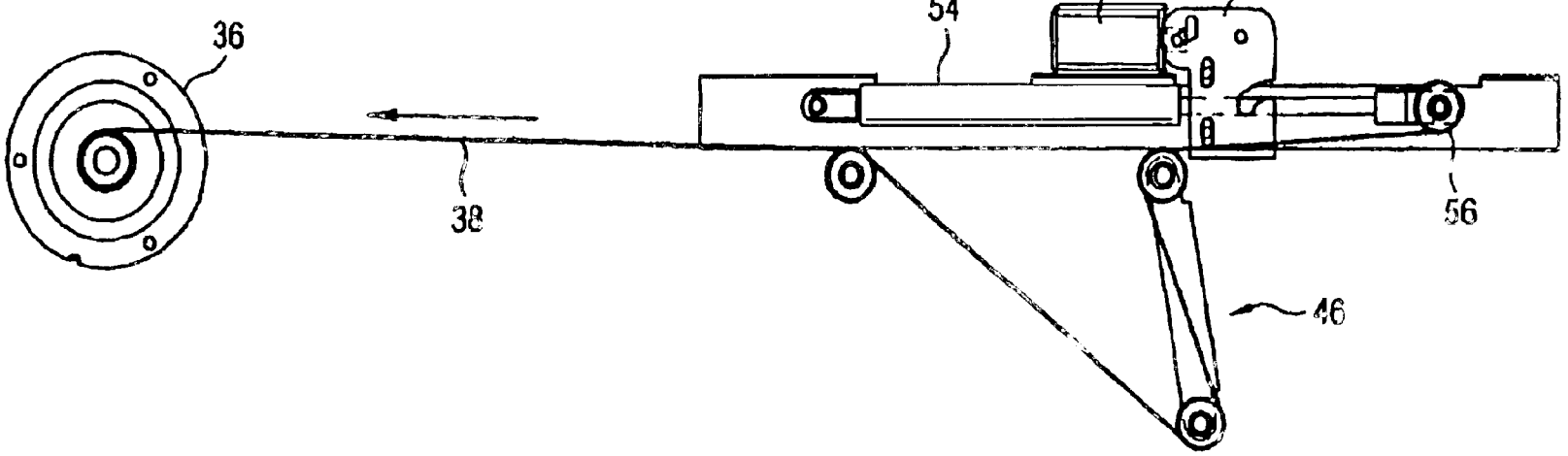
FIG. 15 is a side cross section of a similar exemplary embodiment having a gas compression spring.
FIG. 16 is a status table for normal operation and given malfunction.

FIGS. 14 and 15 show a further exemplary embodiment, whereby a locking mechanism is employed. What is achieved with the assistance of this blocking mechanism is that the spring store is not tensed or relaxed given every movement of the cover device. To this end, the spring store which has been loaded once is locked in its tensed condition. This interlock is released in case of hazard.

FIG. 14 shows a development of the exemplary embodiment according to FIG. 13. Identical parts are identically referenced. The spring 40 is connected to the drive shaft 36 via the traction means 38, for example a wire cable, a chain or a toothed belt. In order to keep the traction means 38 under tension, a traction means tenser 44 is provided that, under spring load, tenses the traction means 38 during normal operation given the back and forth movement of the cover device 16*a* and 16*b*. A detent pawl 46 engages into a detent hook 48. The detent pawl 46 is actuated by an electric retaining magnet 50. A damper 52 that damps the spring movement is connected in parallel to the movement of the spring 40. Given operation of the safety mechanism, the spring 40 is tensed at the beginning once with the assistance of the drive shaft 36 and the traction means 38, potentially with reduced motor speed. The electric retaining magnet 50 holds the detent pawl 46 in the illustrated condition when the operating voltage is present. When the spring 40 is tightened far enough, the detent hook 48 engages into the detent pawl 46. The stroke of the spring 40 is matched to the movement of the cover devices 16*a* and 16*b*.

Given a malfunction, the motor is automatically uncoupled by the magnetic coupling, so that it does not impede further movement by the safety mechanism. Given a lack of operating voltage, the electric retaining magnet 50 disconnects and releases the detent pawl 46. Due to the spring energy stored in the spring 40, the drive shaft 36 is moved in order to bring the cover devices 16*a* and 16*b* into the closed condition. The damper 52 is connected directly in parallel to the spring 40. The closing motion is thus uniformly damped over the entire actuation path. In particular, this damping is needed so that the safety mechanism does not cause a hard impact even when the cover device 16*a* and 16*b* is half-opened.

Advantageously, a gas compression spring that represents a combination of spring store and damping is employed instead of a linear spring 40 and a damper 52. A further advantage of employing gas compression springs is comprised therein that a sudden failure does not occur. Whereas normal mechanical springs can fail suddenly due to breakage even given a correct design, a gas compression spring gradually loses internal pressure toward the end of its service life due to wear of the seals. By monitoring the force needed for opening or for locking, the gas compression spring can be employed until shortly before a minimum internal pressure is reached and a necessary placement can then be indicated via the control panel at the printer.

FIG. 15 shows an embodiment upon employment of a gas compression spring 54. The movable end of the gas compression spring 54 is connected to a deflection roller 56 via which the traction means 38 is deflected. In the illustrated position, the cover device 16 is closed and the gas compression spring 54 is relaxed. A cable is provided as the traction means 38, this being wound onto the drive shaft 36. The drive power of the motor need only be designed for the normal actuation of the cover devices 16*a* and 16*b* since the gas compression spring 54 need only be rarely tensed and a reduced wind-up speed is therefore possible.

FIG. 16 shows a status table for normal operation and given occurrence of a malfunction upon employment of a lockable safety return.

Figure 17:
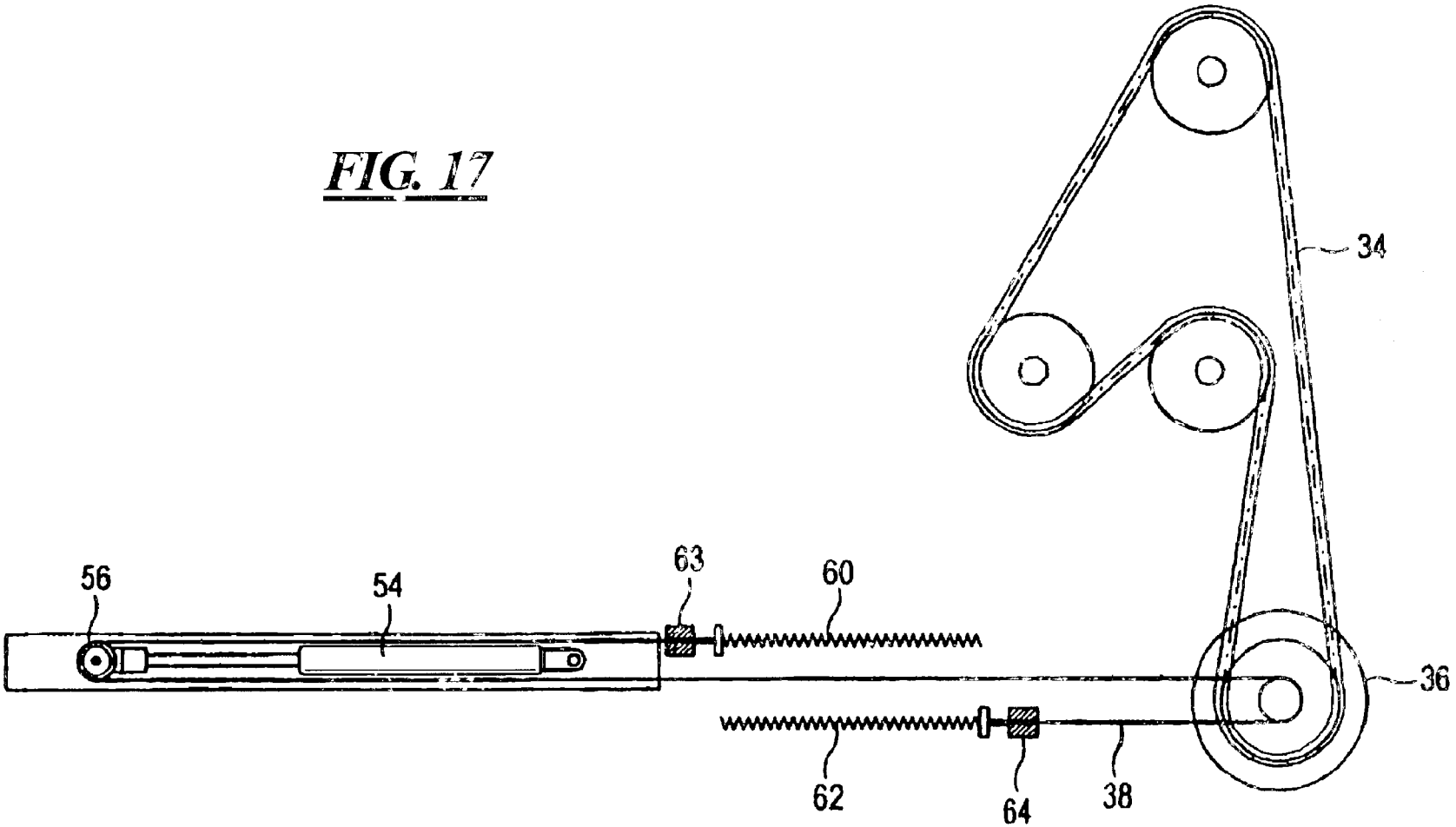
FIG. 17 is a side cross section of an exemplary embodiment for a traction means guidance having two tension springs.

FIG. 17 shows an example of a traction agent guidance with two tension springs 60 and 62 that act at the ends of the traction means 38. This FIG. 17 shows the condition "gas compression spring 54 relaxed" and "cover closed", i.e. before the tightening of the gas compression spring 54 actuation of the gas compression spring 54 in case of malfunction. The overall traction means 38 is moved back and forth between two detents 63 and 64 upon actuation of the cover devices 16*a* and 16*b*. The detent 63 defines the position "cover open"; the detent 64 defines the position "cover closed". Given employment of identical springs 60 and 62, approximately no drive power is needed for moving the traction means. Via the positive lock to the cover devices 16*a* and 16*b*, the illustrated detents also form the limit detents for the movement of the cover devices 16*a*, 16*b*.

Figure 18:
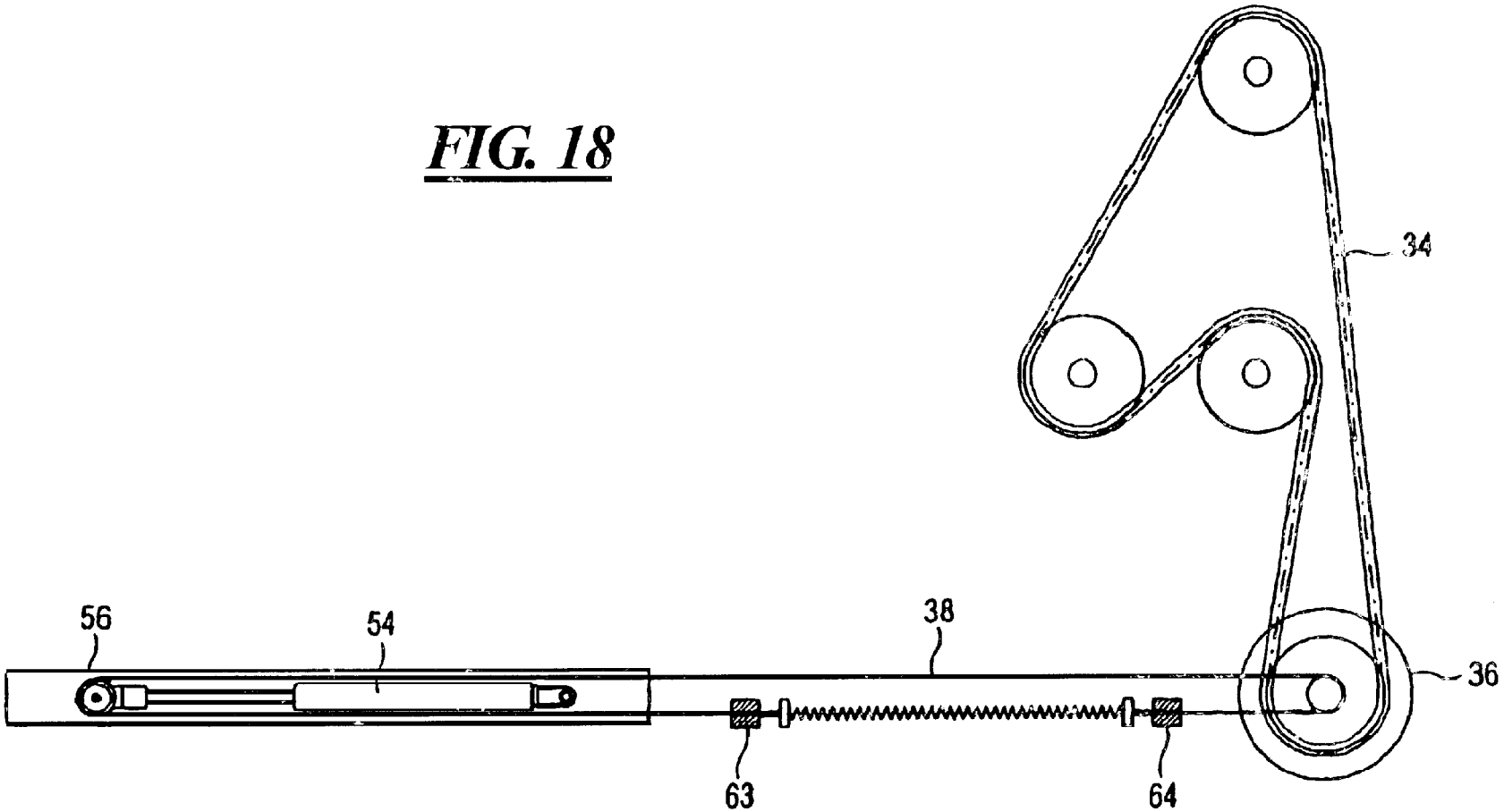
FIG. 18 is a side cross section of a simple arrangement of the traction means guidance.

FIG. 18 shows a further simplification of the arrangement of the traction means 38. Differing from the exemplary embodiment according to claim 17, only one spring 70 with detents is provided. With the gas compression spring 54 tensed, the spring 70 is moved back and forth between these detents with the traction means 38. The translation of the relatively short stroke of the gas compression spring 54 onto the actuation path for the cover device 16*a* and 16*b* ensues via the diameter ratio of the drive wheels 72 and 36. By employing a gas compression spring 54 having a relatively short stroke, installation space is also saved. Due to the symmetrical guidance of the traction means, for example of a chain, it is possible to guide the deflection roller 56 moved by the gas compression spring 54 nearly free of transverse forces.

Figure 19:
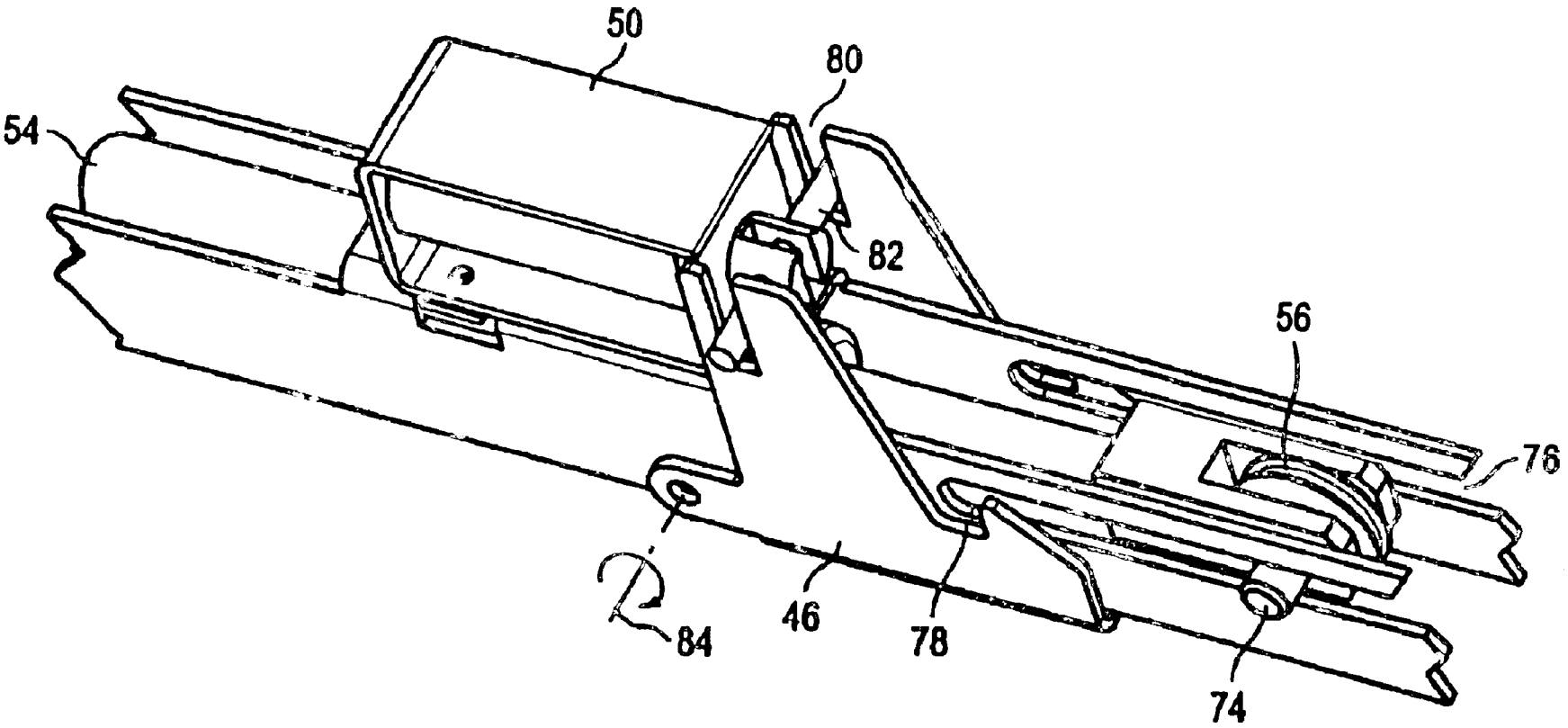
FIG. 19 is a top perspective view of an exemplary embodiment of a combination composed of locking latch and retaining magnet.

FIG. 19 shows the structure of a locking mechanism in combination with the gas compression spring 54. The deflection roller 56 has a cross pin 74 that is guided in a longitudinal guide 76. When the gas compression spring 54 is tensed, the cross pin 74 engages into a recess 78 of the detent pawl 46. The detent pawl 46 has a further recess 80 into which a detent pin 82 of the retainer magnet 50 engages. The detent pawl 46 can be turned around the rotational axis 84. When the retaining magnet 50 which is an electromagnet is charged with an operating voltage, then the detent pawl 46 retains the cross pin 74. The gas compression spring 54 remains in its tense condition, given outage of the operating voltage, the retaining magnet 50 releases the detent pin 82, so that the detent pawl 46 can turn around the rotational axis 84. The cross pin 74 thereby releases from the recess 78, and the deflection roller 46 moves toward the right in FIG. 19 and drives the traction means. As a result of suitable lever relationships at the detent pawl 46, even a slight retaining force of the magnets suffices in order to hold the gas compression spring 54 in the tensed condition.

Figure 20:
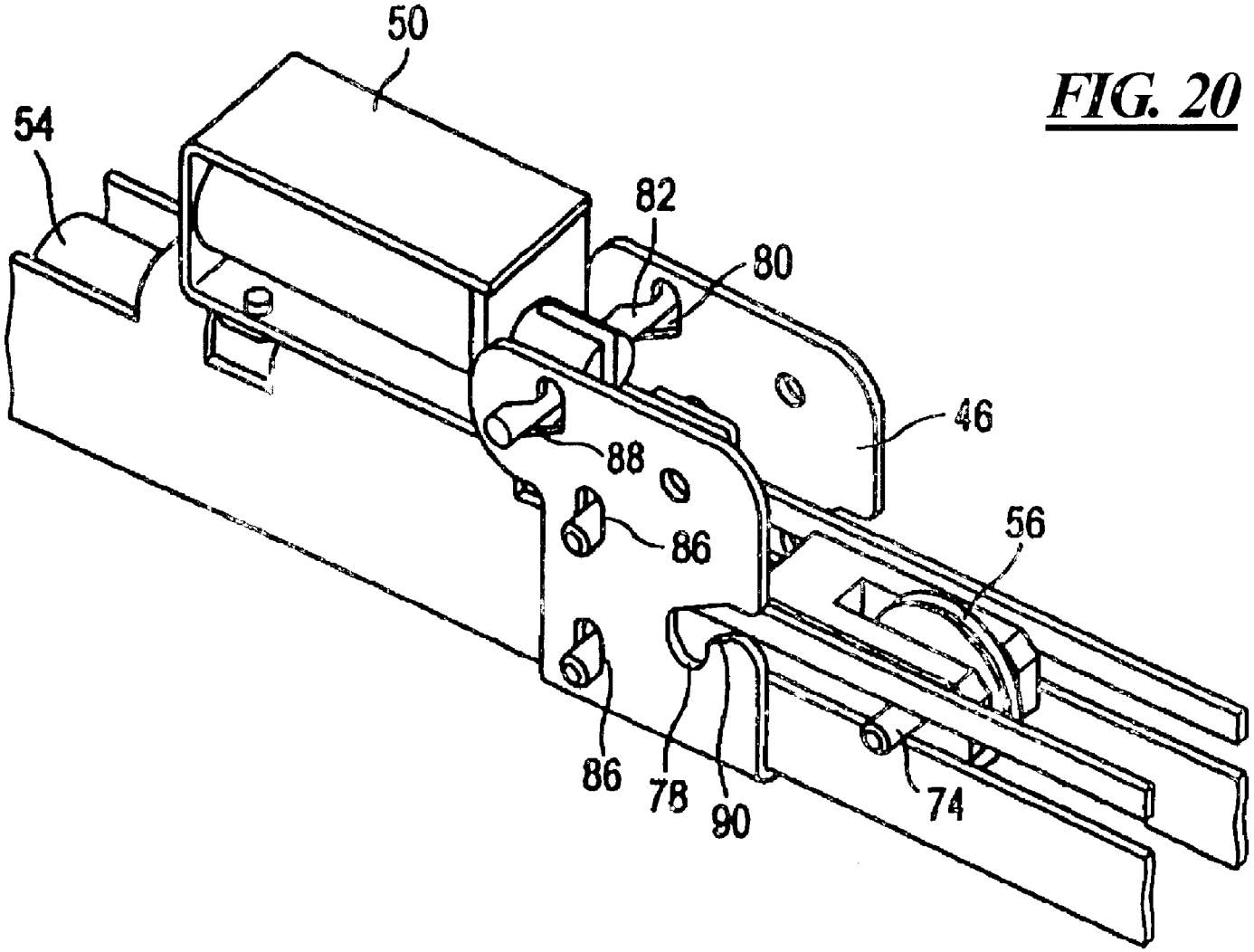
FIG. 20 is a top perspective view of an embodiment of the interlock having a linear movement of the locking latch.

FIG. 20 shows another embodiment of the interlock, whereby the detent pawl 46' implements a linear, vertical movement along oblong holes 86. The recesses 80 and 78 contain guide bevels 88 and 90 that define the force equilibrium in the interlocked condition.

Figure 21:
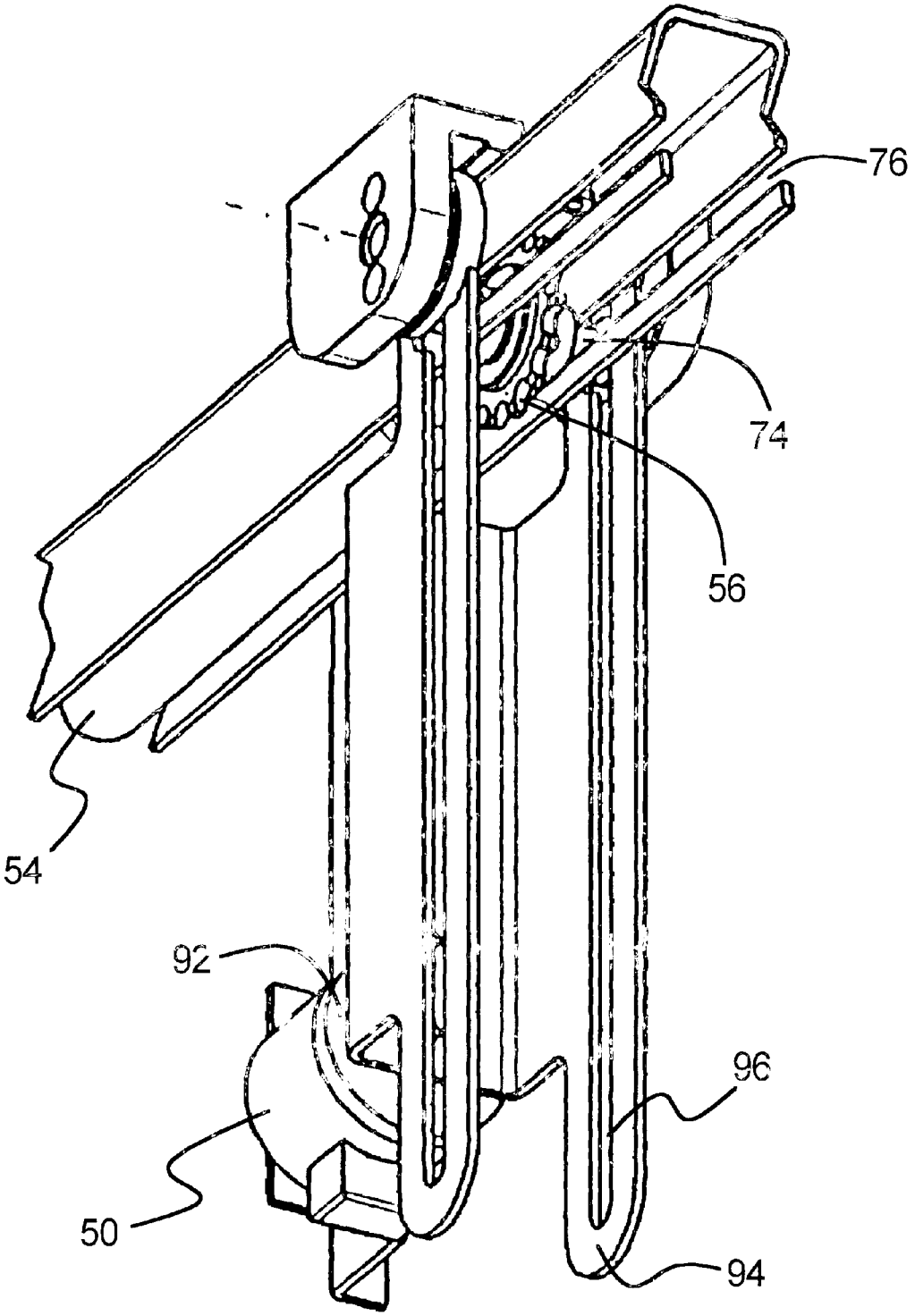
FIG. 21 is an end perspective view of an interlock mechanism having a swivel lever.

FIG. 21 shows a further exemplary embodiment of the interlock mechanism having a swivel lever 94 that contains an oblong hole guide 96. In the locked condition, the retaining magnet 50' holds the swivel lever 94, to which an armature plate 92 is secured. The cross pin 74' of the deflection roller 56', a deflection pinion in this case, is guided both in the longitudinal guide 76' as well as in the oblong hole guide 96. When the electric retaining magnet 50' drops off, then the swivel lever 94 pivots up until oblong hole guide 96 and longitudinal guide 76' are congruent. The cross pin 74 can then move in both guides 79, 76. In this exemplary embodiment, the electric retaining magnet 50 requires only an extremely low retaining force.

Figure 22:
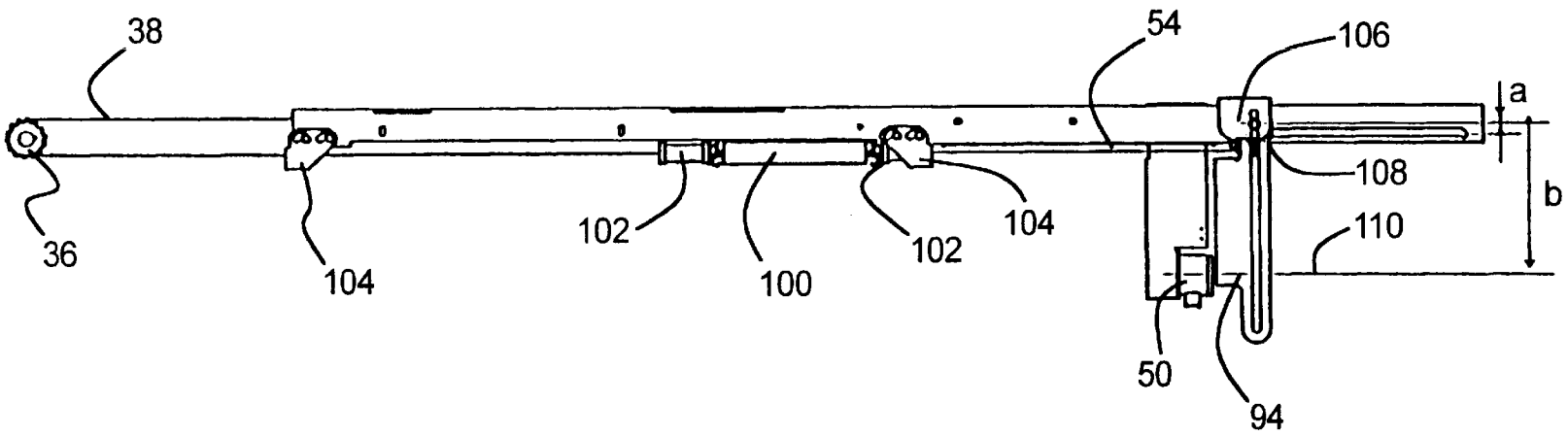
FIG. 22 is a side view of an exemplary embodiment having swivel lever and entrained tension spring.

FIG. 22 shows an exemplary embodiment of a safety mechanism with an interlock on the basis of a swivel lever 94. A chain is provided here as a traction means 38 that is placed on the drive shaft 36 via the pinion. A chain tension spring 100 with damping elements 102 is moved between two limit detents 104. The lever translation of the retaining magnet 50 relative to the gas spring 54 is determined by the ratio distance "a" of the swivel lever pivot point 106 relative to the axis 108 of the gas compression spring 54 relative to the distance "b" of the swivel pivot point 106 from the axis 110 of the retaining magnet 50.

Although other modifications and changes may be suggested by those skilled in the art, it is the intention of the inventor to embody within the patent warranted hereon all changes and modifications as reasonably and properly come within the scope of their contribution to the art.

What is claimed is:

1.A fixing station for fixing toner images on a carrier material which moves passed the fixing station in a moving direction, comprising;

a heating device with at least one radiant heat source that emits radiation in a direction of the carrier material;

a cover device movable essentially parallel to the moving direction of the carrier material and that is moved in to the beam path between said at least one radiant heat source and the carrier material, given a stop of the carrier material the cover device is moved with the velocity VR, according to the relationship: vR=−vP, wherein vP is a transport velocity of the carrier material, and given continued transport of the carrier material with the velocity vP the cover device is moved with the velocity vR, according to the relationship: vR=vP.

2. A fixing station according to claim 1, wherein said cover device has at least a width of the carrier material.

3. A fixing station according to claim 1, wherein said cover device is flexible as viewed in the moving direction of the carrier material.

4. A fixing station according to claim 1, wherein the cover device includes a band.

5. A fixing station according to claim 1, wherein said cover device includes a plurality of strip-shaped lamellae that form a window blind.

6. A fixing station according to claim 1, wherein said cover device in one position is wound up in a fashion of a winding.

7. A fixing station according to claim 1, further comprising:

an endless deflection device is arranged around the heating device; and wherein said cover device is moved along the endless deflection device.

8. A fixing station according to claim 1, further comprising:

a deflection device having a tensing mechanism that keeps said cover device in a tensed condition.

9. A fixing station according to claim 1, wherein said cover device has a length that is adequate to cover an entire radiation of the at least one radiant heat source in a direction of the carrier material.

10. A fixing station according to claim 1, wherein said cover device includes a rigid plate for covering said at least one radiant heat source.

11. A fixing station according to claim 1, wherein said at least one radiant heat source has a radiation temperature in a range from 500° C. through 800° C. and a maximum intensity of radiation lies at a wavelength greater than 2 $\mu$m.

12. A fixing station according to claim 1, wherein said heating device is a first heating device and said cover device is a first cover device, and further comprising:

a second heating device having at least one radiant heat source, said first and second heating devices being arranged at both sides of the carrier material;

a second cover device mounted to be moved into a beam path between said at least one radiant heat source of said second heating device and the carrier material; and a common drive by which said first and second cover devices are moved.

13. A fixing station according to claim 12, wherein said first and second heating devices are constructed to operate in a printer device or copier device that works in duplex printing mode.

14. A fixing station according to claim 1, wherein said at least one radiant heat source is selected from the group consisting of: a ceramic flat radiator, a crystal radiator and a foil radiator.

15. A fixing station according to claim 14, further comprising:

a controller connected so that said at least one radiant heat source is pre-heated.

16. A fixing station according to claim 15, wherein said controller controls said at least one radiant heat source to be pre-heated to a temperature above 200° C.

17. A fixing station according to claim 16, wherein said controller operates so that a temperature Tm is established in a steady state at the carrier material given an operation of the radiant heat source with nominal power NL; and the radiant heat source is pre-heated such that a temperature of approximately 0.45 Tm is established on the carrier material.

18. A fixing station according to claim 17, further comprising:

a power control that supplies electrical energy to said at least one radiant heat source; in an operating condition with constant printing, the power control sets a power of approximately 80% NL, NL being the nominal power; in the operating condition with short stoppage of less than 10 seconds, the power is to set to 60% through 80% NL; given an operating condition with long stoppage of >10 seconds through <5 minutes, a power of 30% through 60% NL is set; in the operating condition of standby mode having a waiting time of >5 minutes, a power of less than 30% NL is set; and given the start operating condition, a power of 100% NL is set.

19. A fixing station according to claim 1, further comprising:

a temperature sensor positioned to acquire a temperature on the carrier material; and a controller connected to said temperature sensor so that energy supplied to said at least one radiant heat source is set such that said at least one radiant heat source lies slightly above a fixing temperature Tf.

20. A fixing station according claim 19, wherein the fixing temperature amounts to 0.8×a temperature Tm which is established in a steady state at the carrier material given an operation of the radiant heat source with nominal power.

21. A fixing station according to claim 1, wherein each of said at least one radiant heat sources is divided to a plurality of zones that are respectively separately supplied with the electrical energy; and the zones are supplied with electrical energy dependent on a width of the carrier material.

22. A fixing station according to claim 21, further comprising:

a controller to control power to said zones opposite which no carrier material resides so that they are driven with reduced power.

23. A fixing station according to claim 21, wherein a longitudinal edge of the carrier material lies within a first of said plurality of zones.

24.A fixing station according to claim 21, wherein a plurality of said zones are combined and driven like a single zone.

25. A fixing station according to claim 21, wherein said heating device is a first heating device and further comprising:

a second heating device disposed opposite said first heating device, said first and second heating devices having zones, said zones residing opposite one another being driven with a same power.

26. A fixing station according to claim 25, wherein said zones residing opposite one another are connected in series.

27. A fixing station according to claim 21, further comprising:

a power control for controlling power to said heating device by one of a pulse packet control and a phase control.

28. A fixing station according to claim 21, further comprising:

a temperature regulator connected such that a temperature higher than a fixing temperature is set in zones having carrier material and a lower temperature is set in zones without carrier material.

29. A fixing station according to claim 28, wherein said temperature regulator performs a temperature regulation only in zones with the carrier material.

30. A fixing station according to claim 1, further comprising:

a drive for said cover device; and a safety mechanism that contains an energy store connected to said cover device so that given outage of the drive for the cover device energy is taken from the energy store with which the cover device is moved by the safety mechanism into a beam path between said at least one radiant heat source and the carrier material.

31. A fixing station according to claim 30, wherein said energy store is a spring energy store.

32. A fixing station according to claim 30, wherein said energy store is connected to be filled with energy given every closing movement of the cover device.

33. A fixing station according to claim 30, wherein the energy store is filled once with energy by the drive of the cover device, and further comprising:

a locking mechanism connected to lock the energy store and to release the energy store given outage of the drive.

34. A fixing station according to claim 33, wherein said locking mechanism includes an electromagnet that is permeated by current during normal operation; and said locking mechanism releasing given outage of the current and drop-off of the electromagnet.

35. A fixing station according to claim 33, wherein said drive for the cover device includes a magnetic coupling that uncouples the drive given outage of the drive.

36. A fixing station according to claim 33, further comprising:

shock absorbers that damp impact of the cover devices.

37. A fixing station according to claim 33, further comprising:

a traction element conducted over a deflection roller.

38. A fixing station according to claim 37, further comprising:

a swivel lever with an oblong hole guide;

a retainer magnet which holds the swivel lever at its projecting end;

a cross pin of the deflection roller guided in a stationary longitudinal guide and in the oblong hole guide;

wherein given a drop-off of the retaining magnet the swivel lever is turned until oblong hole guide and longitudinal guide are aligned with one another and the cross pin moves in both guides.

* * * * *